US008270623B2

(12) United States Patent
Hamilton et al.

(10) Patent No.: US 8,270,623 B2
(45) Date of Patent: Sep. 18, 2012

(54) DEVICES AND METHODS FOR TESTING THE OPERABILITY OF AUDIO SPEAKERS

(75) Inventors: Lance E. Hamilton, Lawrenceburg, KY (US); Andrew I. McGuire, Lexington, KY (US); Troy L. Allen, Georgetown, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 1136 days.

(21) Appl. No.: 12/135,718

(22) Filed: Jun. 9, 2008

(65) Prior Publication Data

US 2009/0304193 A1 Dec. 10, 2009

(51) Int. Cl.
*H04R 29/00* (2006.01)

(52) U.S. Cl. ..... 381/59; 381/58; 381/60; 381/67

(58) Field of Classification Search ..... 381/56–60, 381/322–324, 67

See application file for complete search history.

(56) References Cited

U.S. PATENT DOCUMENTS

| | | | | |
|---|---|---|---|---|
| 3,615,162 | A | 10/1971 | Barber | |
| 3,830,334 | A * | 8/1974 | Costa | 181/131 |
| 4,102,208 | A | 7/1978 | Betz | |
| 4,257,273 | A | 3/1981 | Knowd | |
| 4,908,868 | A | 3/1990 | McTaggart | |
| 5,361,305 | A | 11/1994 | Easley et al. | |
| 6,438,238 | B1 * | 8/2002 | Callahan | 381/67 |
| 6,878,117 | B1 * | 4/2005 | Watrous | 600/528 |
| 6,957,134 | B2 | 10/2005 | Ramseyer et al. | |
| 7,158,649 | B2 * | 1/2007 | Garber et al. | 381/322 |
| 7,270,006 | B2 | 9/2007 | Sper | |
| 2007/0180915 | A1 | 8/2007 | Goldberg et al. | |

* cited by examiner

*Primary Examiner* — Disler Paul
(74) *Attorney, Agent, or Firm* — Dinsmore & Shohl LLP

(57) ABSTRACT

A device for testing the operability of an audio speaker includes a housing, a unidirectional microphone and a display. The underside of the housing comprises a recessed area. The unidirectional microphone is positioned and oriented in the recessed area such that the unidirectional microphone is recessed from the underside of the housing. The display is positioned on the housing such that the display is visible when the testing device is placed proximate an audio speaker with the underside of the housing facing the audio speaker. The display may include at least one visual indicator operatively coupled to the unidirectional microphone such that, when the unidirectional microphone is receiving an acoustic signal, the at least one visual indicator is illuminated.

13 Claims, 3 Drawing Sheets

DEVICES AND METHODS FOR TESTING THE OPERABILITY OF AUDIO SPEAKERS

TECHNICAL FIELD

The present invention generally relates to devices for testing audio equipment and, more specifically, to devices for testing the operability of vehicle audio speakers.

BACKGROUND

Vehicles typically include a plurality of factory-installed audio speakers positioned throughout the passenger compartment. The audio speakers are generally connected to an audio head unit by wires and connectors concealed between the interior finished surfaces of the vehicle and the body of the vehicle. During assembly of the vehicle these wires may become damaged, pinched or disconnected from the audio speaker or the audio head unit thereby rendering the audio speaker inoperable. Vehicle manufacturers incur significant warranty costs when a new vehicle is delivered with inoperable audio speakers. To reduce these warranty costs it is necessary to test the operability of the audio speakers prior to the vehicle leaving the assembly plant.

However, testing the operability of audio speakers while the vehicle is being assembled presents a unique set of challenges. Specifically, the vehicle assembly plant has a significant amount of background and environmental noise at a particularly high volume. This background and environmental noise makes it difficult to isolate and/or detect the audible noise produced by the audio speaker with conventional audio detectors or detection equipment.

Accordingly, a need exists for an alternative testing devices for testing the operability of audio speakers during the assembly of a vehicle.

SUMMARY

In one embodiment, a device for testing the operability of an audio speaker includes a housing, a unidirectional microphone and a display. The underside of the housing may include a recessed area. The unidirectional microphone is positioned and oriented in the recessed area such that the unidirectional microphone is recessed from the underside of the housing. The display is positioned on the housing such that the display is visible when the testing device is placed proximate an audio speaker with the underside of the housing facing the audio speaker. The display may include at least one visual indicator operatively coupled to the unidirectional microphone such that, when the unidirectional microphone is receiving an acoustic signal, the at least one visual indicator is activated.

In another embodiment, a method for testing the operability of an audio speaker located in a vehicle during the assembly of the vehicle includes positioning a testing device comprising a housing, a unidirectional microphone and a plurality of LEDs directly against a speaker cover oriented over the audio speaker. The housing may include a top and an underside. The underside of the housing may include a recessed area. The unidirectional microphone may be located on the underside of the housing and positioned and oriented in the recessed area such that, when the testing device is placed proximate the audio speaker with the underside of the testing device facing the audio speaker, the unidirectional microphone is recessed from the underside of the housing and oriented towards the audio speaker. The plurality of LEDs may be operatively coupled to the unidirectional microphone such that, when the unidirectional microphone is receiving an acoustic signal, at least one LED is illuminated. The housing may be enclosed in a rubber case, the rubber case having an opening proximate the recessed area. The testing device may be positioned against the speaker cover such that the underside of the housing is facing the speaker cover, the rubber case is in direct contact with the speaker cover thereby preventing the testing device from damaging the speaker cover and the unidirectional microphone is directed towards the audio speaker such that any acoustic signal received by the unidirectional microphone is substantially from the audio speaker. An audio head unit operatively associated with the audio speaker may then be turned on such that, if the audio speaker and the audio head unit are properly connected and operable, an acoustic signal will emanate from the audio speaker. The LEDs on the testing device are observed to determine if an acoustic signal is emanating from the audio speaker.

In yet another embodiment, a testing device for testing the operability of an audio speaker, includes a housing, a microphone and a display. The housing may include a top and an underside, wherein the underside of the housing has a recessed area and a raised rib extending around the recessed area. The microphone may be located on the underside of the housing and positioned in the recessed area such that, when the testing device is placed proximate the audio speaker with the underside of the testing device facing the audio speaker, the microphone is recessed from the underside of the housing and oriented towards the audio speaker. The display may be positioned on the housing such that the display is visible when the testing device is placed proximate the audio speaker with the underside of the housing facing the audio speaker. The display may include at least one LED and is operatively coupled to the microphone such that, when the unidirectional microphone is receiving an acoustic signal, the at least one LED is illuminated.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION

Figure 1:
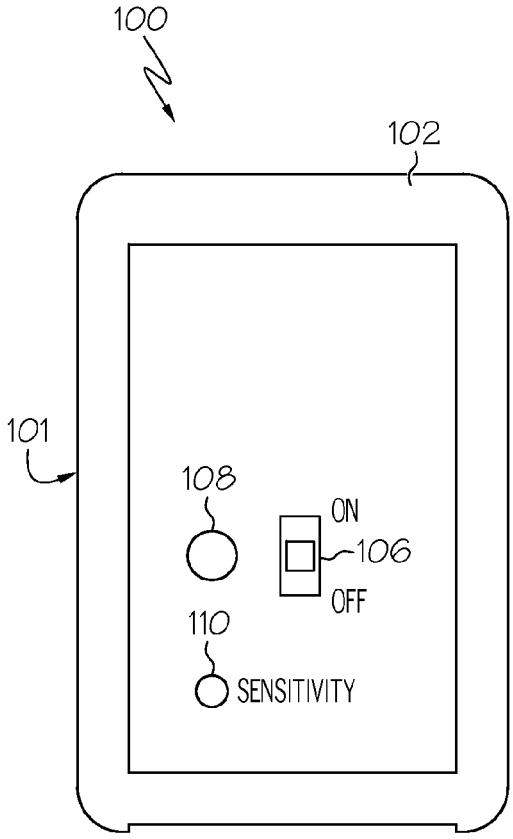
FIG. 1 depicts a schematic view of the top of a testing device for testing the operability of audio speakers according to one embodiment described herein.

FIG. 1 generally depicts a testing device for testing or verifying the operability of vehicle audio speakers. The testing device generally comprises a housing, a microphone, and a display panel. The testing device and methods for using the testing device will be described in more detail herein.

Figure 2:
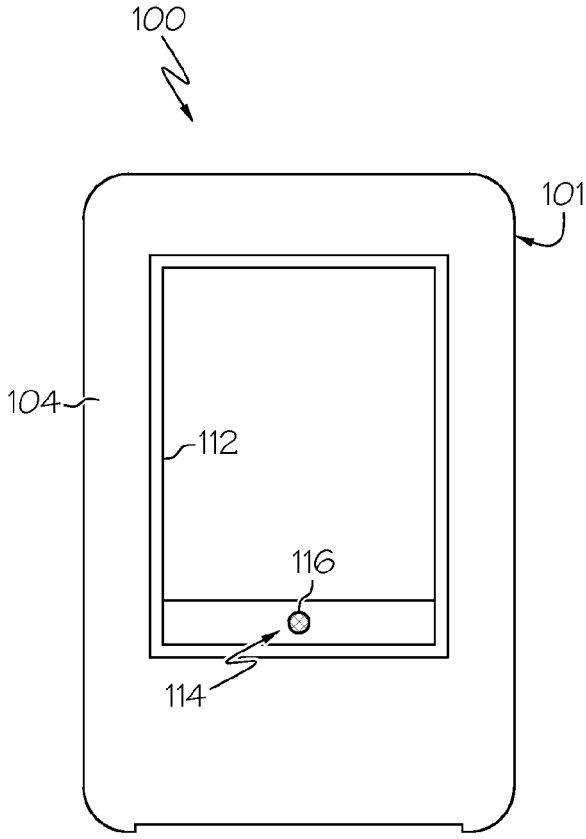
FIG. 2 depicts a schematic view of the bottom of a testing device for testing the operability of audio speakers according to another embodiment described herein.
Figure 3:
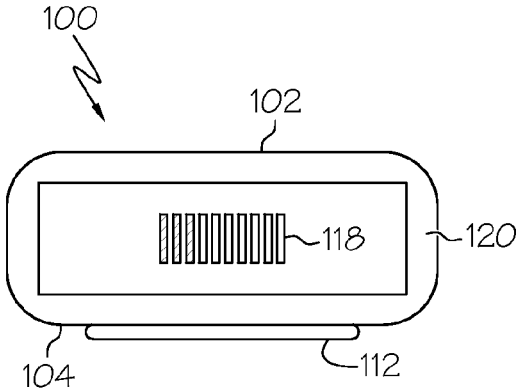
FIG. 3 depicts a schematic view of the display of the testing device of FIGS. 1 and 2 according to another embodiment described herein.

Referring to FIG. 1-3, a testing device 100 for verifying the operability of vehicle audio speakers is shown. The testing device 100 generally comprises a housing 101 in which a microphone 116 and a display panel 118 are mounted. In addition, various testing device controls may also be mounted in the housing 101. For example, as shown in FIG. 1 which depicts the top 102 of the testing device 100, the housing 101 may also contain a power switch 106, a power on indicator 108 and a sensitivity control 110 for adjusting the sensitivity of the testing device 100. However, it should be understood that, while FIG. 1 depicts the various testing device controls positioned on the top 102 of the testing device 100, the testing device controls may be positioned along any side of the testing device 100 or on the bottom 104 of the testing device.

The housing 101 may be constructed from any suitable material including, without limitation, polymers, composites, metals and the like. In one embodiment, the housing 101 may comprise a coating, such as a no-scratch coating, such that, when the testing device 100 comes in contact with the interior finishes of a vehicle, the testing device 100 does not scratch or otherwise damage the interior finishes. For example, the coating may comprise a polymer or rubber coating. Alternatively, the coating may comprises a rubber case or sheath in which the housing 101 is inserted. The case or sheath may have various openings through which the microphone 116, display panel 118 and various other testing device controls extend.

The microphone 116 may be positioned on the underside 104 of the housing 101. In one embodiment, as shown in FIG. 2, the microphone 116 may be positioned in a recessed area 114 located on the underside 104 of the housing 101 such that the microphone 116 is recessed from the underside 104 of the housing 101. Positioning the microphone 116 in the recessed area 114 protects the microphone 116 from damage when the testing device 100 is placed on a surface. Further, placing the microphone 116 in the recessed area 114 also prevents the microphone 116 from scratching or damaging a surface on which the testing device 100 is placed.

It should be understood that, while the recessed area 114 is generally depicted in FIG. 2 as a rectangular slot, the recessed area 114 may be of any suitable geometric configuration such that the microphone 116 may be recessed from the underside 104 of the housing 101. For example, the recessed area 114 may be configured to have the same general geometric configuration as a cross section of the microphone 116 such that microphone 116 fits snugly in the recessed area 114.

The microphone 116 may comprise a unidirectional microphone which may be positioned and oriented in the housing 101 to receive an acoustic signal from a specific, pre-determined direction. More specifically, the unidirectional microphone may be positioned and oriented in the housing 101 such that, when the testing device is positioned over an audio speaker, the an acoustic signal received from the microphone is substantially from the audio speaker and not from the surrounding environment. By positioning the unidirectional microphone in this manner ambient or background sound (e.g., any acoustic signal not emanating from the audio speaker) may be reduced and/or eliminated thereby providing a more accurate determination of the operability of the audio speaker.

In one embodiment, the underside 104 of the housing 101 may also contain an isolation member 112 which generally surrounds the recessed area 114 and the microphone 116. The isolation member may generally comprise a raised rib extending circumferentially around the microphone 116. When the testing device is placed proximate an audio speaker, such as when the underside of the testing apparatus is placed in direct contact with the speaker cover of an audio speaker, the isolation member forms a barrier extending circumferentially around the microphone which substantially blocks ambient or background sound (e.g., any acoustic signal not emanating from the audio speaker) from being received by the microphone thereby providing a more accurate determination as to the operability of the audio speaker. Further, the isolation member 112 may also protect the microphone 116 from damage by increasing the distance between the microphone 116 and any surface on which the testing device 100 is positioned.

While FIG. 2 generally depicts the isolation member 112 as extending around the microphone 116 and recessed area 114 such that the isolation member 112 is spaced apart from the microphone 116 and recessed area 114, it should be understood that the isolation member 112 may be directly adjacent the recessed area 114. Moreover, when the recessed area 114 is the same general geometric configuration as a cross section of the microphone 116, the isolation member 112 may be directly adjacent the microphone 116.

In one embodiment, the isolation member 112 may be integrally formed with the housing 101. In another embodiment, the isolation member 112 may comprise a sound dampening material affixed to the underside 104 of the housing 101 with an epoxy, glue or other adhesive. The sound dampening material may comprise felt, foam rubber, rubber or any suitable sound dampening material. In yet another embodiment, when the housing 101 is enclosed in a rubber or polymer case or sheath as described hereinabove, the isolation member 112 may be integrally formed with the case or sheath. In one embodiment, the material from which the isolation member 112 is formed may be selected such that, when the testing unit 100 is positioned on a sloped or inclined surface, the testing unit 100 does not slide with respect to the surface.

The testing unit 100 may also include a display 118 as shown in FIG. 3. The display 118 is positioned in the housing 101 of the testing unit 100 such that the display 118 is visible to a user of the testing unit 100 when the testing unit 100 is positioned on an audio speaker with the underside 104 of the testing unit 100 facing the cover of the audio speaker. Accordingly, while the testing unit shown in FIGS. 1-3 depicts the display as being positioned on a side 120 of the testing unit 100, the display 118 may also be positioned on the top 102 of the testing unit 100.

The display 118 may be operatively connected to the microphone 116 (as will be discussed further herein) such that, when an acoustic signal is received by the microphone 116, the display 118 visually indicates that the microphone 116 is receiving an acoustic signal. Accordingly, the display 118 may comprise one or more visual indicators including, without limitation, LED indicators and the like. In the embodiment shown in FIG. 3, the display 118 comprises an LED display bar which includes a plurality of LED indicators which are illuminated when the microphone 116 receives an acoustic signal.

In another embodiment, when the display 118 comprises a plurality of visual indicators, the number of visual indicators which are illuminated when an acoustic signal is received by the microphone 116 is proportional to the level or intensity of the acoustic signal received by the microphone 116. For example, when the display 118 comprises an LED display bar as depicted in FIG. 3, the number of LEDs which are illuminated may be directly proportional to the level or intensity of the acoustic signal received by the microphone 116. The sensitivity of the testing unit 100 may be adjusted (as will be discussed further herein) which, in turn, increases or decreases the number of LEDs which are illuminated for a particular level or intensity of the acoustic signal received by the microphone 116. Accordingly, the testing unit 100 may be calibrated to detect an acoustic signal of a particular level or intensity and thereby determine if both the audio speaker and the associated audio head unit are functioning properly.

Figure 4:
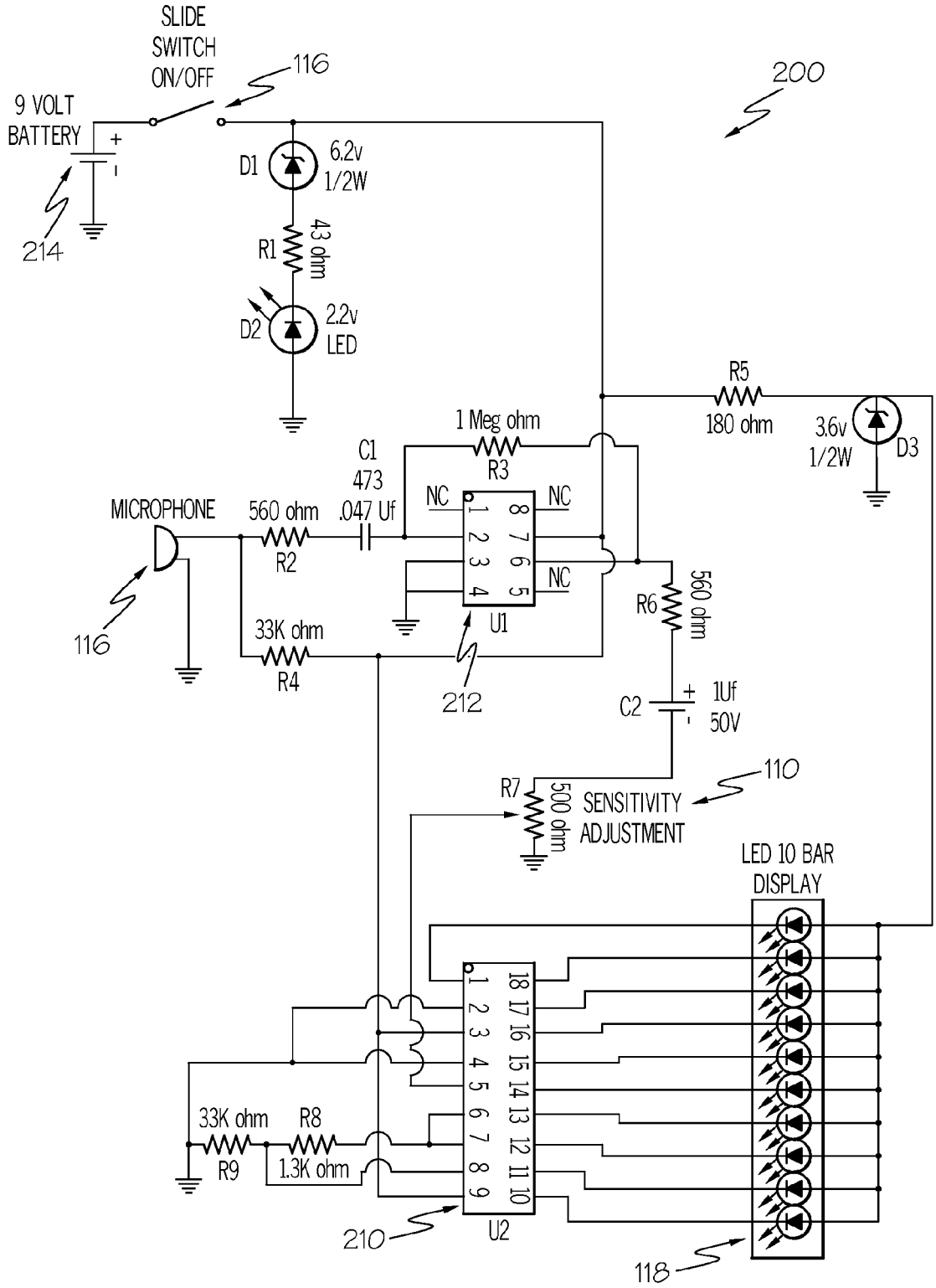
FIG. 4 depicts a circuit diagram for the testing device of FIGS. 1-3 according to one embodiment described herein.

Referring now to the circuit diagram shown in FIG. 4 by way of example, an exemplary circuit 200 for the testing device 100 of FIGS. 1-3 is shown. The circuit 200 depicted in FIG. 4 may be enclosed and/or contained in the housing 101 of the testing device 100. The circuit 200 generally contains a power source 214, the power switch 106, the power on indicator 108, the microphone 116, a microphone operational amplifier 212, the sensitivity control 110, a display driver 210 and the display 118. The circuit 200 may also comprise various resistors, diodes and capacitors to facilitate the interconnectivity and operability of the circuit. The various components may be generally connected as shown in the circuit diagram of FIG. 4. In one embodiment, the power source 214 may comprise a battery such as a nine-volt battery. The power on indicator 108 may comprise an LED or similar visual indicator. As discussed hereinabove, the microphone 116 may comprise a directional microphone and may be operatively connected to the microphone operational amplifier 212 which amplifies the electrical signal received from the microphone 116. The sensitivity control 110 may comprise a potentiometer operatively coupled to the microphone operational amplifier 212 and the display driver 210. The sensitivity control 110 may include a knob or screw accessible from outside the housing 101. The knob or screw may be turned to adjust (e.g., increase or decrease) the resistance of the potentiometer which, in turn, increases or decreases the sensitivity of the testing device 100. The display driver 210 may be operatively coupled to the display 118 and the microphone operational amplifier 212 such that the amplified signal of the microphone 116 is passed to the display driver 210. In one embodiment, when the display driver 210 receives a signal from the microphone operational amplifier 212 indicative of the level or intensity of the acoustic signal received by the microphone 216, the display driver 210 illuminates all the LEDs in the display 118. In another embodiment, the display driver 210 illuminates a number of LEDs in proportion to the signal received from the microphone operational amplifier 212. The number of LEDs that are illuminated for a particular level or intensity of the acoustic signal received by the microphone 116 may be adjusted by increasing or decreasing the sensitivity of the testing device 100 with the sensitivity control 110.

In operation, the microphone 116 receives an acoustic signal (e.g., sound) and converts the acoustic signal to an electrical signal which is passed to the microphone operational amplifier 212. The microphone operational amplifier 212 amplifies the electrical signal from the microphone 216 and relays the signal to the display driver 210. In one embodiment, when the display driver 210 receives an amplified signal from the microphone operational amplifier 212, the display driver 210 illuminates all the LEDs associated with the display 118. In another embodiment, when the display driver 210 receives an amplified signal from the microphone operational amplifier 212, the number of LEDs in the display 118 illuminated by the display driver 210 is in proportion to the voltage of the signal received by the display driver 210 from the microphone operational amplifier 212. In this embodiment, the voltage of the signal output from the microphone operational amplifier 212 may be proportional to the acoustic signal received by the microphone 116. Accordingly, the number of LEDs illuminated in the display 118 will be proportional to the acoustic signal received by the microphone 116.

While the circuit diagram shown in FIG. 4 generally depicts one exemplary embodiment of a circuit that may facilitate the operation of the testing device as described herein, it should be understood that the circuit may have a variety of other constructions and may consist of various other components oriented to construct a circuit having the same functionality as will be apparent to one skilled in the art. Accordingly, unless otherwise stated herein, no particular limitation is intended as to the particular components and/or construction of the circuit used to achieve the functionality of the testing device.

Figure 5:
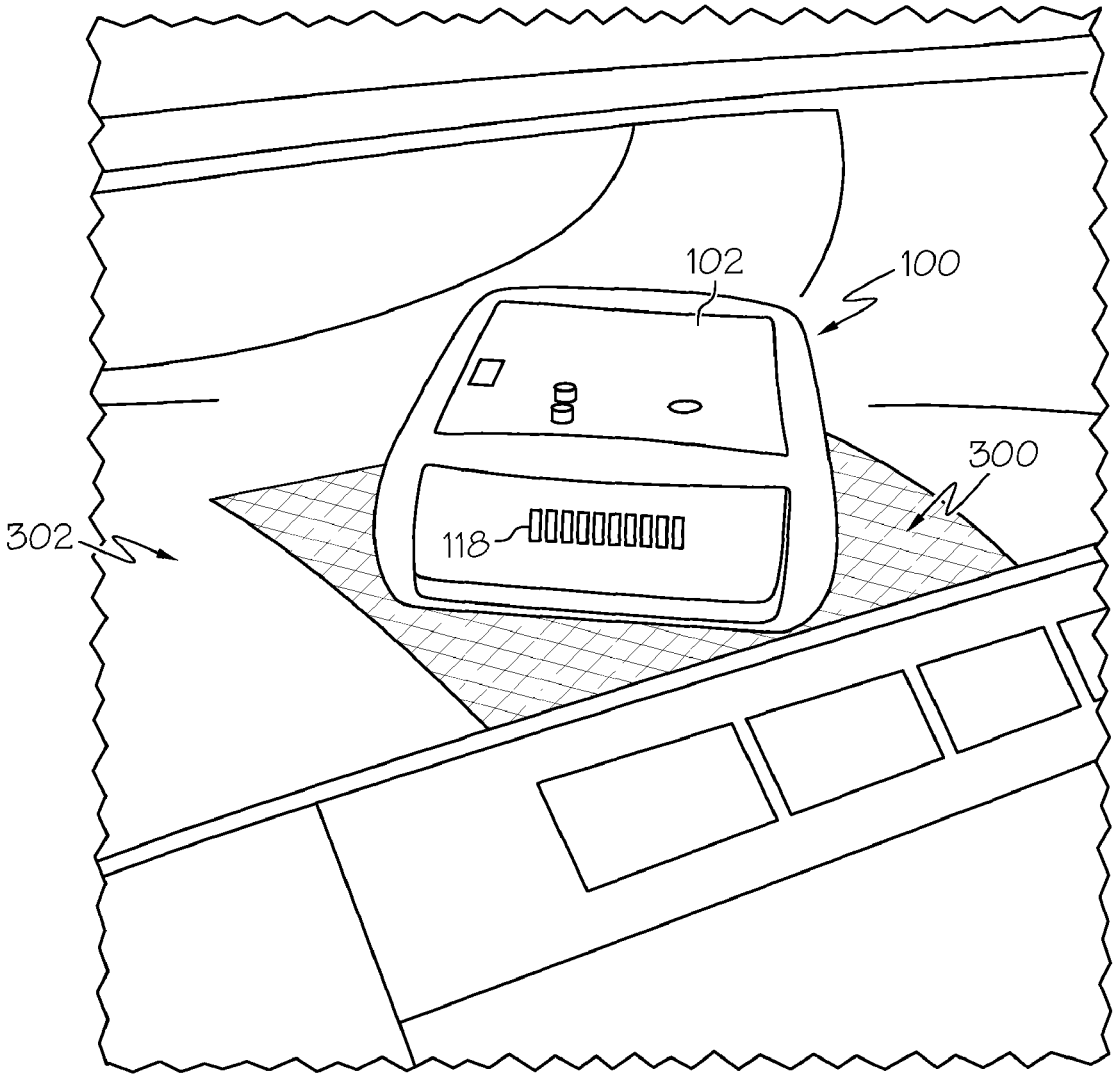
FIG. 5 depicts the testing device of FIGS. 1-3 positioned on a speaker cover of an audio speaker.

Referring now to FIG. 5, the testing device 100 is shown in use, positioned on a speaker cover 300 of a speaker (not shown) located in an instrument panel 301 of a vehicle. The testing device 100 is positioned on the speaker cover 300 such that the underside (not shown) and microphone (not shown) of the testing device are facing the speaker. The isolation member (not shown) located on the underside of the testing device 100 may rest directly on the speaker cover 300 thereby preventing the microphone from receiving the background or ambient noise. Further, when the testing device 100 is placed on the speaker cover 300 in this orientation, the microphone of the testing device 100 may be positioned and/or directed to substantially receive only the acoustic signal emanating from the speaker and not ambient or background noise.

While the testing device 100 may be shown in FIG. 5 as being placed on a substantially horizontal speaker cover 300, it should be understood that the testing device 100 may also be used in conjunction with a speaker/speaker cover oriented substantially vertically. In this orientation the user of the testing device may hold the testing device against the speaker cover such that the isolation member on the underside of the testing device 100 is pressed against the speaker cover such that the microphone is oriented to receive an acoustic signal from the audio speaker and the isolation member blocks ambient or background noise from being received by the microphone.

With the testing device 100 in place on the speaker cover 300, the audio head unit of the vehicle may be turned on such that an acoustic signal emanates from the audio speaker. When the testing device 100 receives an acoustic signal emanating from the audio speaker, the display 118 of the testing device 100 is illuminated thereby indicating that the audio speaker located beneath the speaker cover 300 is operating properly. If no acoustic signal emanates from the audio speaker, the display 118 of the testing device 100 does not illuminate thereby indicating that the audio speaker is not functioning properly and that the audio speaker, the audio head unit, and/or the connection between the audio speaker and the audio head unit is/are in need of repair and or replacement.

In another embodiment, in addition to checking the basic operability of the audio speaker and/or the audio head unit, the testing device 100 may also be used to assess the strength of the signal received by the audio speaker from the audio head unit. In this embodiment, the testing device 100 is calibrated to illuminate a specified number of LEDs for an acoustic signal of a given level or intensity by adjusting the sensitivity of the device. The testing device 100 is then placed proximate the audio speaker, as described above, and the audio head unit is set to send a signal to the audio head unit corresponding to the given acoustic signal intensity. If the specified number of LEDs are illuminated on the display 118 of the testing device 100, then the audio head unit is functioning properly. If the number of LEDs is more or less than the specified number of LEDs, then the audio head unit may need to be adjusted and/or repaired.

It should now be understood that the testing device described herein may be used to verify the operability of an audio speaker and, more particularly, audio speakers and related components installed in a vehicle during assembly of the vehicle. The use of a directional microphone and/or isolation member assists in blocking or mitigating the ambient or background noise commonly found in a vehicle assembly plant and which may otherwise adversely effect the performance of the testing device.

Further, the testing device described herein is compact and easy for a user to carry and operate and the display of the testing device provides an instantaneous indication of the operability of the audio speaker thus improving the overall efficiency of the audio speaker testing process.

While reference is made herein to using the testing device to test audio speakers located in a vehicle during assembly of the vehicle, it should be understood that the testing device described herein may also be used to test any audio speaker under conditions where it is necessary to isolate the testing device from ambient or background noise and thereby improve the results obtained by the testing device.

While particular embodiments and aspects of the present invention have been illustrated and described herein, various other changes and modifications can be made without departing from the spirit and scope of the invention. Moreover, although various inventive aspects have been described herein, such aspects need not be utilized in combination. It is therefore intended that the appended claims cover all such changes and modifications that are within the scope of this invention.

What is claimed is:

1. A testing device for testing the operability of an audio speaker, the testing device comprising a housing, a unidirectional microphone and a display wherein:

the housing comprises a planar top, a planar underside, and an isolation member, wherein the underside of the housing comprises a recessed area and the isolation member comprises a raised rib extending from the planar underside of the housing;

the unidirectional microphone is located on the planar underside of the housing and positioned in the recessed area with the raised rib extending circumferentially around and directly adjacent to the unidirectional microphone such that, when the testing device is placed proximate the audio speaker with the underside of the testing device facing the audio speaker, the unidirectional microphone is recessed from the planar underside of the housing and oriented towards the audio speaker;

the display is positioned on the housing such that the display is visible when the testing device is placed proximate the audio speaker with the planar underside of the housing facing the audio speaker; and the display comprises at least one visual indicator and is operatively coupled to the unidirectional microphone such that, when the unidirectional microphone is receiving an acoustic signal, the at least one visual indicator is activated.

2. The testing device of claim 1 wherein the at least one visual indicator comprises a plurality of visual indicators and the number of visual indicators illuminated when the unidirectional microphone is receiving an acoustic signal is proportional to a level or intensity of acoustic signal received by the unidirectional microphone.

3. The testing device of claim 1 wherein the housing comprises a coating such that, when the housing is positioned on a speaker cover, the testing device does not scratch or damage the speaker cover.

4. The testing device of claim 3 wherein the coating comprises a rubber case enclosing the housing, the rubber case comprising an opening proximate the unidirectional microphone.

5. The testing device of claim 4 wherein the rubber case is integrally formed with the isolation member.

6. The testing device of claim 1 wherein the isolation member is integrally formed with the housing.

7. The testing device of claim 1 wherein the isolation member comprises a sound dampening material affixed to the underside of the housing.

8. A testing device for testing the operability of an audio speaker, the testing device comprising a housing, a circuit contained within the housing, a microphone and a display wherein:

the housing comprises a planar top and a planar underside, wherein the planar underside of the housing comprises a recessed area and a raised rib extending around the recessed area;

the circuit comprises a power source, a power switch, and a power on indicator;

the microphone is operative coupled to the circuit and is located on the planar underside of the housing and positioned in the recessed area such that, when the testing device is placed proximate the audio speaker with the planar underside of the testing device facing the audio speaker, the microphone is recessed from the planar underside of the housing and oriented towards the audio speaker;

the display is operatively coupled to the circuit and is positioned on the housing such that the display is visible when the testing device is placed proximate the audio speaker with the planar underside of the housing facing the audio speaker; and the display comprises at least one LED operatively coupled to the microphone such that, when the microphone is receiving an acoustic signal, the at least one LED is illuminated.

9. The testing device of claim 8 wherein the raised rib comprises a sound dampening material affixed to the underside of the housing.

10. The testing device of claim 8 wherein the raised rib is integrally formed with the housing.

11. The testing device of claim 8 wherein the number of the LEDs illuminated when an acoustic signal is received from the microphone is proportional to the level and/or intensity of the acoustic signal received by the microphone.

12. The testing device of claim 8 wherein the housing in enclosed in a rubber case, the rubber case having an opening proximate the recessed portion such that at least the microphone is exposed through the opening.

13. The testing device of claim 8 wherein the microphone is a unidirectional microphone.

* * * * *